US005284426A

United States Patent [19]

Strikis et al.

[11] Patent Number: 5,284,426

[45] Date of Patent: Feb. 8, 1994

[54] ROTARY COMPRESSOR WITH MULTIPLE COMPRESSOR STAGES AND PUMPING CAPACITY CONTROL

[75] Inventors: Guntis V. Strikis, Belleville; Vipen K. Khetarpal, Novi, both of Mich.

[73] Assignee: Ford Motor Company, Dearborn, Mich.

[21] Appl. No.: 31,510

[22] Filed: Mar. 15, 1993

[51] Int. Cl.[5] ..... F01C 1/30

[52] U.S. Cl. ..... 418/6; 418/11; 418/13; 418/23; 418/59

[58] Field of Search ..... 418/6, 7, 8, 11, 13, 418/23, 59

[56] References Cited

U.S. PATENT DOCUMENTS

| | | | |
|---|---|---|---|
| 4,397,618 | 8/1983 | Stenzel | 418/23 |
| 4,737,088 | 4/1988 | Taniguchi et al. | 418/63 |
| 5,009,577 | 4/1991 | Hayase et al. | 417/295 |
| 5,015,161 | 5/1991 | Amin et al. | 418/6 |
| 5,135,368 | 8/1992 | Amin et al. | 418/6 |

FOREIGN PATENT DOCUMENTS

| | | | |
|---|---|---|---|
| 59-51187 | 3/1984 | Japan . | |
| 62-265484 | 11/1987 | Japan . | |
| 0500375 | 4/1976 | U.S.S.R. | 418/6 |
| 10187 | of 1895 | United Kingdom . | |

OTHER PUBLICATIONS

"A Study On Dynamic Behavior Of A Scroll Compressor", 1986 International Compressor Engineering Conference at Purdue, vol. IV, Aug. 4–7, 1986, pp. 901–916.

*Primary Examiner*—Richard A. Bertsch
*Assistant Examiner*—Charles G. Freay
*Attorney, Agent, or Firm*—Roger L. May; Raymond L. Coppiellie

[57] ABSTRACT

A multiple stage rotary compressor having a housing with a pump cavity, an orbiting ring piston in the cavity, a cylindrical post carried by the housing within the orbiting ring, a pair of vanes engaging the outer surface of the orbiting ring to define a pair of primary pumping chambers in the cavity and a second pair of internal vanes contacting the inner surface of the orbiting ring to define a pair of secondary pumping chambers and a capacity controller adapted to selectively disable each of the outer vanes to establish differing compressor pump capacities depending upon the operating requirements of the compressor.

5 Claims, 10 Drawing Sheets

ROTARY COMPRESSOR WITH MULTIPLE COMPRESSOR STAGES AND PUMPING CAPACITY CONTROL

TECHNICAL FIELD

This invention relates to refrigerant gas compressors, particularly rotary piston compressors for automotive climate control systems.

BACKGROUND OF THE INVENTION

It is well known in the art of climate controls for automotive vehicles to provide reciprocating piston compressors for pressurizing a refrigerant such as freon gas. It is also known practice to use a scroll type compressor, which tends to reduce vibrations caused by reciprocating pistons and to provide higher volumetric and mechanical efficiency. The dynamic behavior of such conventional compressors is described in the literature; e.g., a paper entitled A Study On Dynamic Behavior Of A Scroll Compressor, published in the 1986 International Compressor Engineering Conference at Purdue University, Vol. 3, Aug. 4–7, 1986. The authors are Ishii, Fukushima, Sano and Sawai.

With the introduction of an alternate refrigerant commonly known as "R134A", which may replace freon gas as a refrigerant in automotive vehicle air conditioning systems, it is necessary to provide higher operating pressures. This tends to introduce problems associated with sealing the refrigerant. The use of this alternate refrigerant also makes it necessary to provide a higher volumetric efficiency than the efficiencies associated with compressors used with Freon gas and to deal with higher temperature of the inlet gas.

An example of a compressor that is adapted especially for use with "R134A" refrigerant gas is disclosed in U.S. Pat. No. 5,015,161, which is assigned to the assignee of the present invention. The '161 patent describes a refrigerant gas compressor having high overall operating efficiency with minimal internal leakage notwithstanding the presence of higher compression levels. The compressor of the '161 patent comprises a two stage rotary ring piston which reduces the pressure differential across the rotary mechanism thereby reducing sealing problems. The rotary piston in the structure of the '161 patent is an orbiting piston which cooperates with a compression chamber and an internal cylindrical post to define two first stage compression chambers and two second stage pressure chambers. The output of the first stage supplies the inlet of the second stage. The orbiting ring piston, which is located between the cylindrical post and the housing wall, rotates about an axis that is offset from the axis of the post as the outer surface of the orbiting ring piston contacts the inner surface of the housing and the inner surface of the orbiting ring piston contacts the outer surface of the post.

External vanes slidably mounted in the housing engage the outer surface of the orbiting ring piston to define two discrete first stage compression chambers. The inner vanes are slidably mounted on the post as they engage the inner surface of the orbiting ring piston, thus defining two discrete second stage compression chambers. The two compression chambers of the second stage are divided and are dynamically sealed, one with respect to the other, at the tangent contact points between the outer surface of the cylindrical post and the inner surface of the orbiting ring piston. Similarly, the compression chambers of the first stage are divided and are dynamically sealed, one with respect to the other, at the rotating points of tangential contact between the outer surface of the orbiting ring piston and the inner surface of the housing.

Refrigerant gas discharged from the first stage is directed through inlet ports to the second stage. Gas discharged from the second stage passes through the compressor outlet to the evaporator and condenser in the air conditioning system.

The positions of the vanes and the respective compression chambers change in relation to the inlet ports in accordance with the variable position of the orbiting ring piston. The vanes are adapted to open and close inlet ports as they move in a generally radial direction relative to the axis of the orbiting ring piston.

BRIEF DESCRIPTION OF THE INVENTION

The present invention comprises improvements in a double stage orbiting ring piston compressor of the kind described in the '161 patent. It is characterized by a relatively high efficiency at low speeds. It is adaptable for high pressure ratios at low speeds with relatively high volumetric and mechanical efficiencies.

According to a principal feature of the present invention, we have provided a double stage orbiting ring piston compressor wherein provision is made for varying the compressor capacity depending upon the operating requirements. Thus, it is not necessary to operate the compressor at maximum capacity when only partial load is demanded by the operating environment for the air conditioning system. The parasitic losses associated with powering of the compressor in the air conditioning system are reduced.

Variable capacity control is achieved in our improved compressor by selectively disabling the outer vanes that cooperate with the outer perimeter of the orbiting ring piston. Either one or both of two outer vanes can be selectively disabled. With both outer vanes fully active, the compressor will operate, of course, with 100% capacity. If one of the vanes is deactivated the compressor will operate at a capacity of approximately 70%. If both vanes are deactivated, the compressor will operate at a capacity of approximately 50%.

The vanes of our improved compressor are selectively activated and deactivated by a suitable locking mechanism. In the preferred embodiment described in this specification, we use a solenoid controller for selectively locking the outer vanes, but other types of mechanism, such as a pressure actuated plunger or detent, also can be used. When partial compressor capacity is demanded, the controller for one outer vane interferes with radial movement of that outer vane, thus causing the vane to be held in an inoperative position out of tangential contact with the orbiting ring piston. Similarly, the second outer vane can be deactivated by a second controller by holding it in an inoperative position. When both vanes are in their inoperative positions, the compressor will continue to function, but the compressor action is achieved only by reason of the pumping action of the second stage defined by the inner vanes, the cooperating cylindrical post and the inner surface of the orbiting ring piston.

We are aware of prior art compressor designs using an orbiting ring piston wherein a provision is made for disabling an outer vane. An example of this is shown in U.S. Pat. No. 4,397,618, where a solenoid actuator interferes with radial movement in an outer vane to prevent compressor action of an orbiting ring piston. This is intended as a substitute for a converter clutch which completely disables or enables the compressor. It is not used for the purpose of controlling compressor capacity. It is merely an on/off control. A similar design is shown in Japanese Patent Publication 59-51,187 dated Mar. 24, 1984. As in the case of the '618 patent, the structure of the Japanese patent publication includes a solenoid operated locking device for a vane, which is a substitute for an on/off compressor drive clutch for enabling and disabling the compressor.

PARTICULAR DESCRIPTION OF THE INVENTION

Figure 1A:
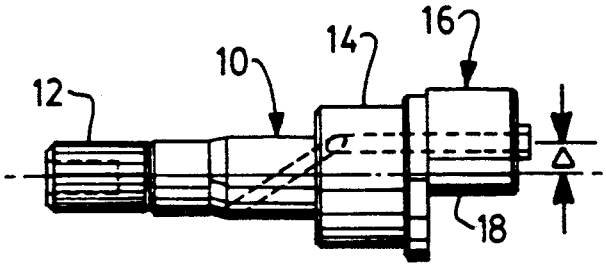
FIG. 1*a* is a side elevational view of a compressor drive shaft and crank for driving an orbiting ring compressor.

In FIG. 1*a*, the driveshaft for the orbiting ring piston is identified by reference numeral 10. It comprises a spline portion 12 adapted to be connected to a drive pulley, not shown, driven by the vehicle engine crankshaft. A cylindrical bearing portion 14 is adapted to be received in a cylindrical bearing opening formed in the compressor housing to be described subsequently.

Figure 1B:
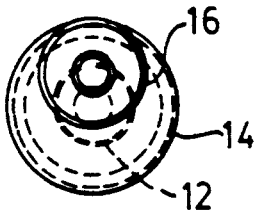
FIG. 1*b* is an end view of the drive shaft of FIG. 1A as seen from the plane of section line 1*b* of FIG. 1A.

A crank portion 16, seen in FIGS. 1*a*, 1*b*, and 1*c* comprises an outer cylindrical surface 18 which is received in a bearing opening formed in the orbital ring piston, as will be explained subsequently. The axis of the cylindrical surface 18 is offset from the axis of the shaft 10 by an amount Δ as indicated in FIG. 1A.

Figure 1C:
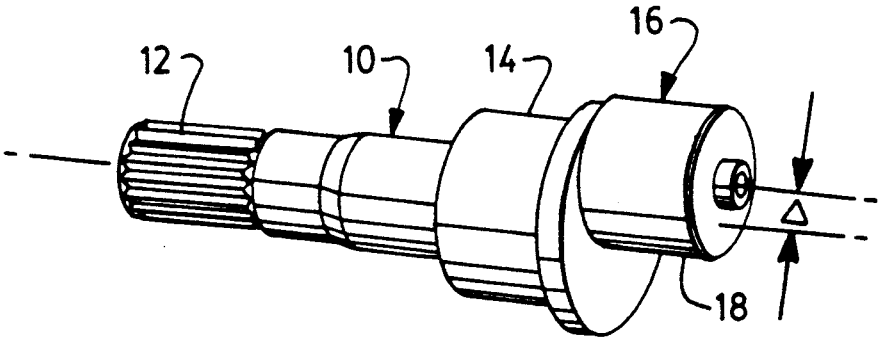
FIG. 1*c* is an isometric view the drive shaft and eccentric crank seen in FIGS. 1*a* and 1*b;*
Figure 2:
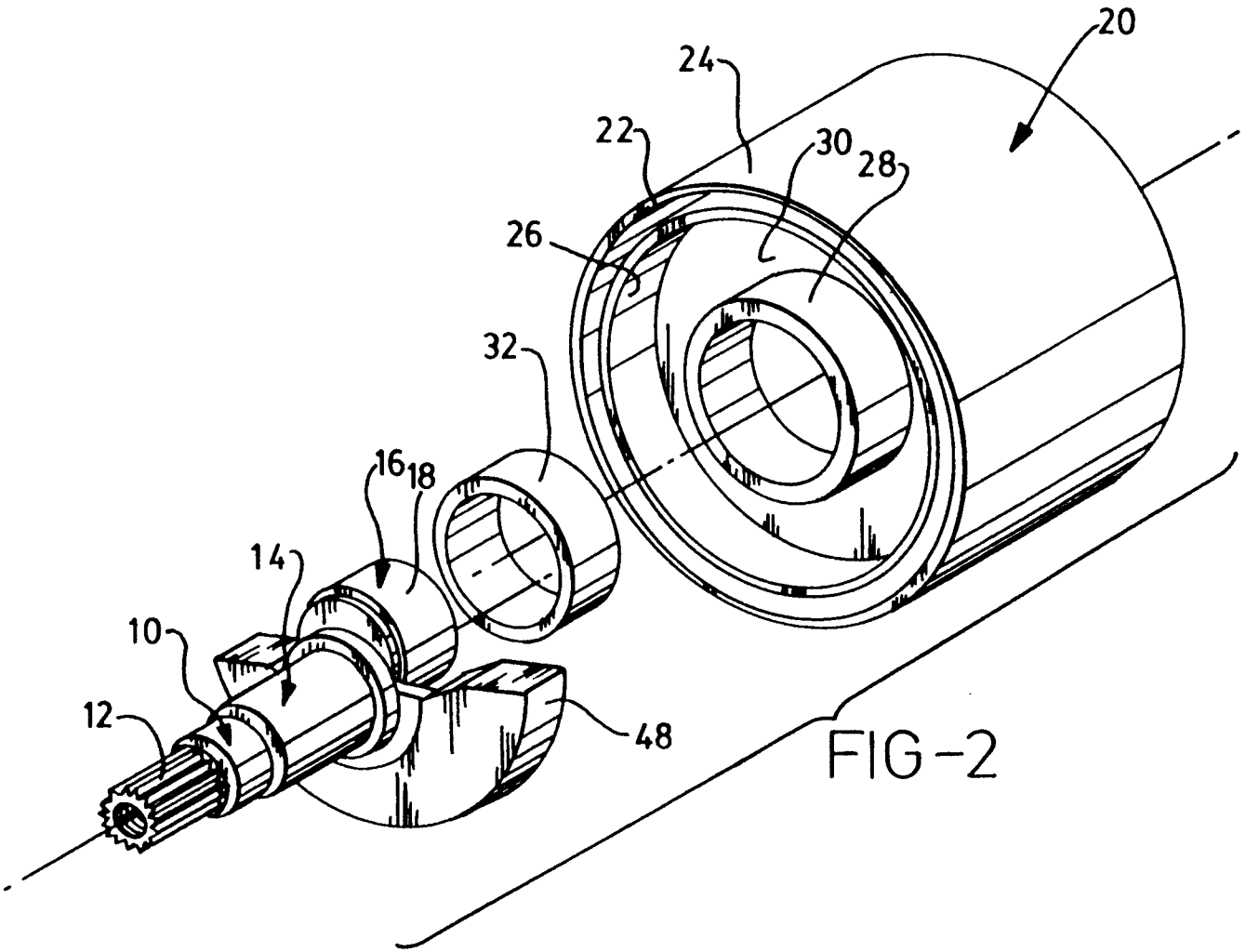
FIG. 2 is an isometric view showing the crank, the crank driver for the orbiting ring piston, the orbiting ring piston and the drive shaft.

FIG. 1C shows the driveshaft with the crank portion in perspective. FIG. 2 shows the torque input shaft, the crank portion and the orbital ring piston in isometric, spaced relationship.

In FIG. 2, the orbiting ring piston is identified generally by reference numeral 20. It comprises an outer ring 22 having a cylindrical outer surface 24 and a cylindrical inner surface 26. A cylindrical boss 28 is concentrically positioned with respect to the cylindrical surfaces 24 and 26. It is connected to the ring 22 by a radial web 30.

The boss 28, when the orbiting ring piston is assembled on the shaft 10, surrounds surface 18. A bushing 32 is located between surface 18 and the inner cylindrical surface of the boss 28, thus rotatably supporting the orbiting ring piston 20 on the crank portion 16.

Figure 1D:
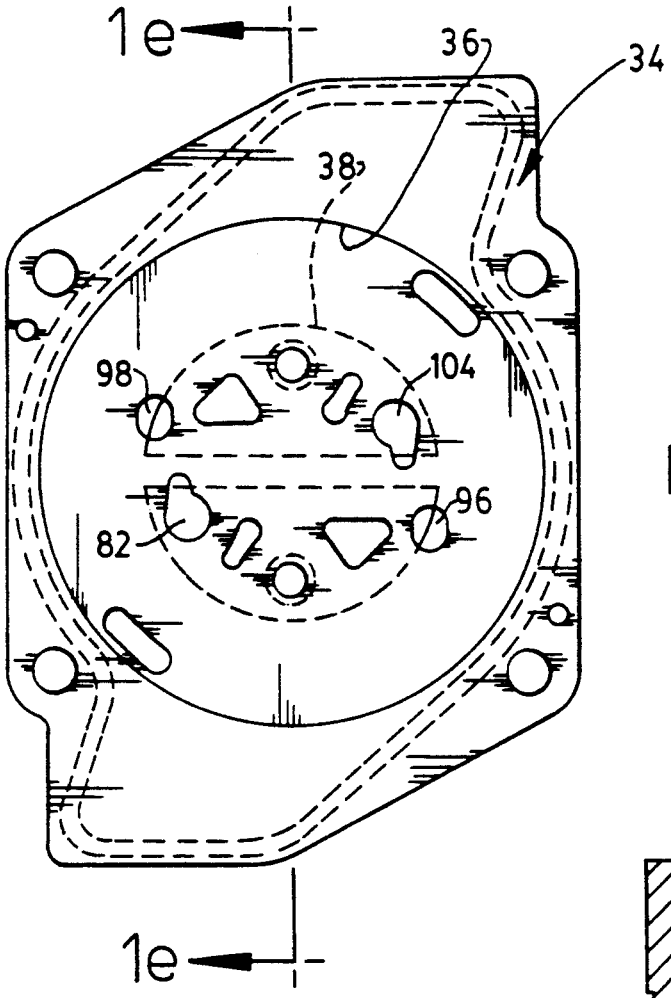
FIG. 1*d* is a portion of the housing for the compressor, which includes a cylindrical inner post located within a pumping cavity.

In FIG. 1D, the compressor housing is identified generally by reference numeral 34. It comprises a cylindrical compressor pumping chamber 36, which receives a cylindrical post 38. The latter has a cylindrical outer surface and is concentric with respect to the inner surface of the pumping chamber 36.

Figure 1E:
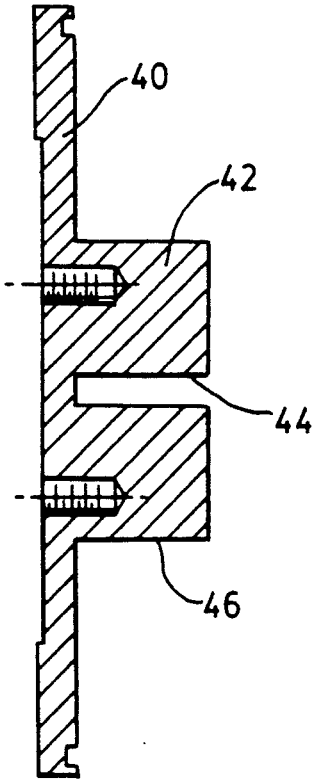
FIG 1*e* is a view taken along the plane of section line 1*e* of FIG. 1*d;*

FIG. 1E shows a cross-sectional view of the post. It comprises a plate extending radially, as shown at 40. Plate 40 is secured to the housing on one axial side of the housing chamber 36. A cylindrical post 42 forms a part of the plate 40. A vane slot 44 extends diametrically through the cylindrical post 42. As will be explained with reference to FIGS. 3A through 3K, the cylindrical surface 46 of the post 42 is in engagement with the inner cylindrical surface 26 of the orbital ring piston as the outer cylindrical surface 24 of the orbital ring piston contacts the inner cylindrical surface of the housing chamber 36.

As seen in FIG. 2, a counterweight 48 is carried by the shaft 10 adjacent the crank portion 16. As the shaft 10 rotates, the centrifugal force due to the rotating members located on the axis of the boss 28 is counteracted and balanced by the centrifugal force created by the counterweight 48.

In FIGS. 3A through 3K, the housing opening 36, the post and the orbital ring piston are shown schematically. The orbital ring piston, the post and the chamber 36 cooperate to define first and second pumping stages. The suction port for the first pumping stage is shown at 50. The outlet port for the first stage is formed in the housing 34 at 52. The cylindrical outer surface 24 of the orbiting ring piston contacts the cylindrical inner surface of the housing chamber 36 at contact point 54 when the orbital ring piston is in the position shown in FIG. 3A. The outer cylindrical surface of the post 38 contacts the inner cylindrical surface 26 of the orbital ring piston at point 56.

The housing 34 is formed with a slot 58 that receives a first outer vane 60. The vane 60 is adapted to move in a generally radial direction. With respect to the center of the post 38. A light spring 62 acts on the radially outward end of the vane 60 and urges the vane into contact with the cylindrical outer surface 24 of the orbital ring piston, as shown at 64.

The vane 60 has a valve recess 66 which registers with suction port 50. When the vane 60 moves in a radially inward direction, the recess 66 provides communication between suction port 50 and a gas chamber 68 located between the inner cylindrical surface 36 of the housing and the outer cylindrical surface 24 of the orbital ring piston.

Located 180° from the slot 58 is a second slot 58' formed in the housing 34. A second outer vane 60' is slidably positioned in the slot 58'. The inner end of the vane 60' engages the outer surface 24 of the orbital ring piston, as shown at 64'. A second first stage outlet port 52' communicates with a crescent shape gas chamber defined by the inner surface of chamber 36 of the housing and the outer surface 24 of the orbital ring piston. It is located directly adjacent vane 60'. Likewise, the port 52 is located directly adjacent vane 60.

Figure 3A:
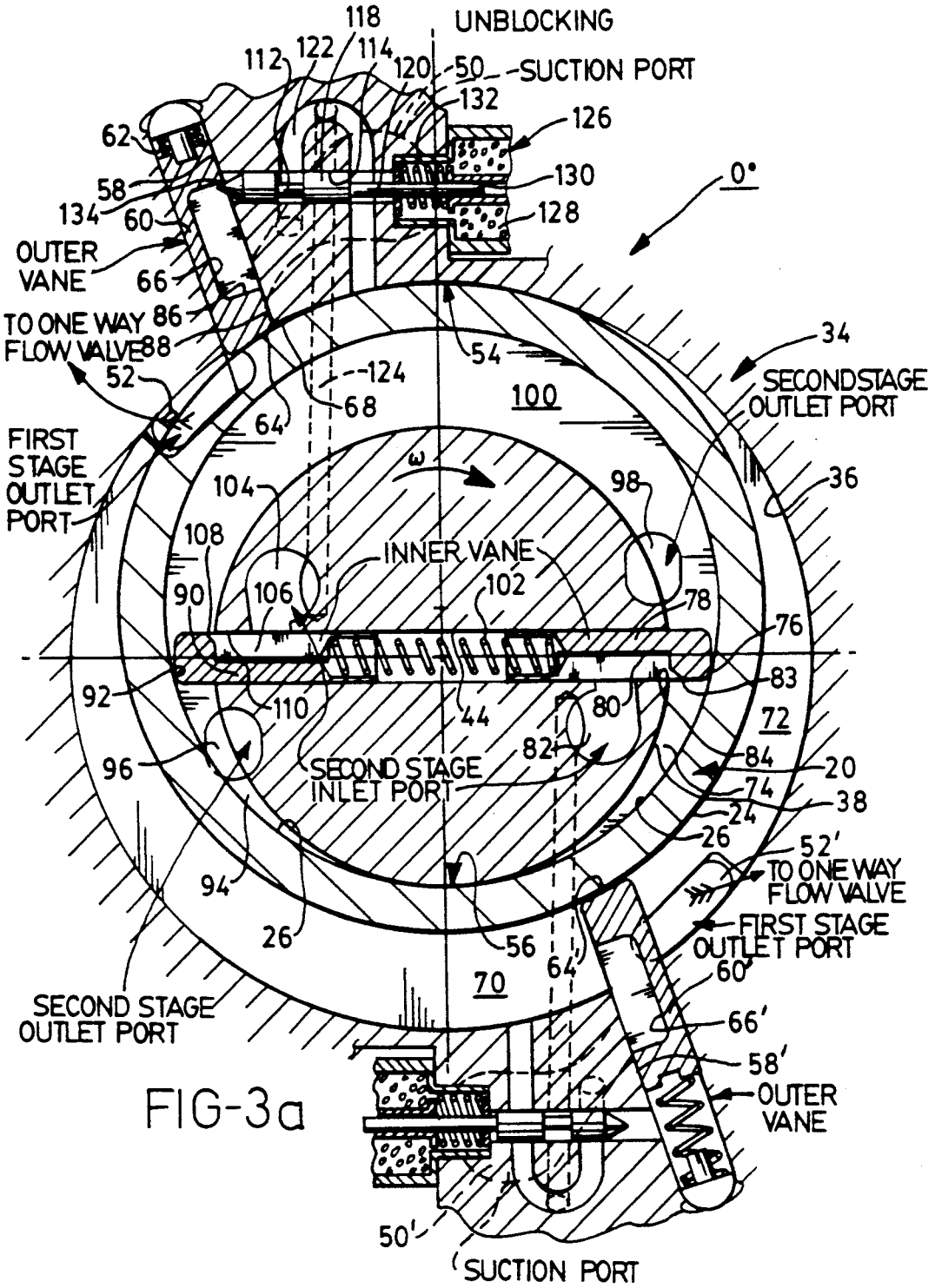
FIGS. 3*a* through 3K show schematic assembly views of the compressor housing, the orbiting ring piston, the inner post and the inner and outer vanes. Each view shows the orbiting ring in a different angular position relative to the pumping chamber in the housing.

The vane 60' has a valve recess 66' which registers with suction port 50'. When vane 60' is positioned as shown in FIG. 3A, communication is established between suction port 50' and crescent shaped chamber 70 defined by the outer surface of the orbital ring piston 24 and the inner cylindrical surface of the opening 36. This crescent shaped chamber corresponds to crescent shaped chamber 72 located between the first stage outlet port 52' and the vane 58.

As the orbital ring piston rotates in its orbital path in the direction of the arrow "ω" as shown in FIG. 3*a*, the crescent shaped chamber 72 will progressively decrease in volume as the crescent shaped chamber 70 decreases in volume. This will be explained subsequently. Gas that passes through the port 52 flows through a one way flow valve (not shown). The one way flow valve will permit transfer of refrigerant gas from the crescent shaped chamber 70, but will prevent reverse flow. Likewise, port 52' accommodates the flow of gas from the chamber 72'. A one way flow valve (not shown) is located in the port 52' to prevent reverse flow as in the case of the port 52.

A second stage pumping chamber of crescent shape is shown at 74. It is defined by the outer surface of the post 38 and the inner cylindrical surface 26 of the orbital ring piston 20. It extends from contact point 56 to contact point 76 for a first inner vane 78.

Vane 79 is slidably positioned in the vane slot 44 as mentioned earlier. It comprises a valve slot 80 which establishes communication between second stage inlet port 82 and crescent shaped chamber 74. The radially outward edge of the valve slot 80 defines a valve land 83 that registers with a valve land 84 formed on the edge of the second stage inlet port 82. In a similar fashion, the radially inward edge of the vane slot 66 of the outer vane 60 defines a valve land 86 which registers with valve land 88 formed at the edge of the suction port 50.

A second inner vane for the second stage is shown at 90, which is located 180° out of position with respect to the vane 78. Vane 90 and vane 78 are located in the common vane slot 44. The outer edge of the vane 90 engages the inner cylindrical surface 26 of the orbital ring piston as shown at 92. Another second stage gas chamber 94 is defined by the outer cylindrical surface of the post 38 and the inner cylindrical surface 26 of the orbital ring piston.

Chamber 94, as seen in FIG. 3*a*, extends from contact point 56 between the inner cylindrical surface 26 and the outer cylindrical surface of the post 38 to the contact point 92 for the inner vane 90.

A second stage outlet port 96 communicates with chamber 94 as the piston travels in its orbital path. Another second stage outlet port 98 communicates the crescent shaped pumping chambers defined by the inner surface 26 of the orbiting ring piston and the outer surface of the post 38. In the position of the orbital ring piston shown in FIG. 3*a*, the crescent chamber 100, which corresponds to either of the second stage chambers 94 or 74 in the angular disposition of the compressor elements shown in FIG. 3*a*, extends from contact point 92 for the vane 90 and contact point 76 for the vane 78.

A light spring 102 located in slot 44 urges the inner vanes 90 and 78 into contact with the inner surface 26 of the orbital ring piston.

A second stage inlet port is shown at 104. This corresponds to the second stage inlet port 82. The second stage inlet port 104 communicates with the first stage outlet port 52 through internal porting and passages formed in the housing 34. Similarly, the first stage outlet port 52' communicates with second stage inlet port 82 through internal porting and passages formed in the housing 34. The internal porting and passages is not specifically disclosed in the drawings. It would correspond, however, to the inlet porting and passages described in U.S. Pat. No. 5,015,561, previously described. Reference may be made to that patent to supplement the description in this specification.

For purposes of describing the operation of the compressor, the position of the orbiting ring piston is shown in successive angular positions in FIGS. 3*a* through 3*k*. In FIG. 3*a* the orbiting ring piston is in a so-called "zero" angular position. If the orbiting ring piston is rotated 30° in a clockwise direction from the position shown in FIG. 3*a*, the orbiting ring piston, the vanes, the post and the housing ports will assume the relative positions shown in FIG. 3*b*. At that time contact point 54 is displaced 30° relative to the vertical axis 104 and relative to the horizontal axis 106. The axes 104 and 106 intersect at the center 108 of the driveshaft 10.

Figures 3B, 3C:
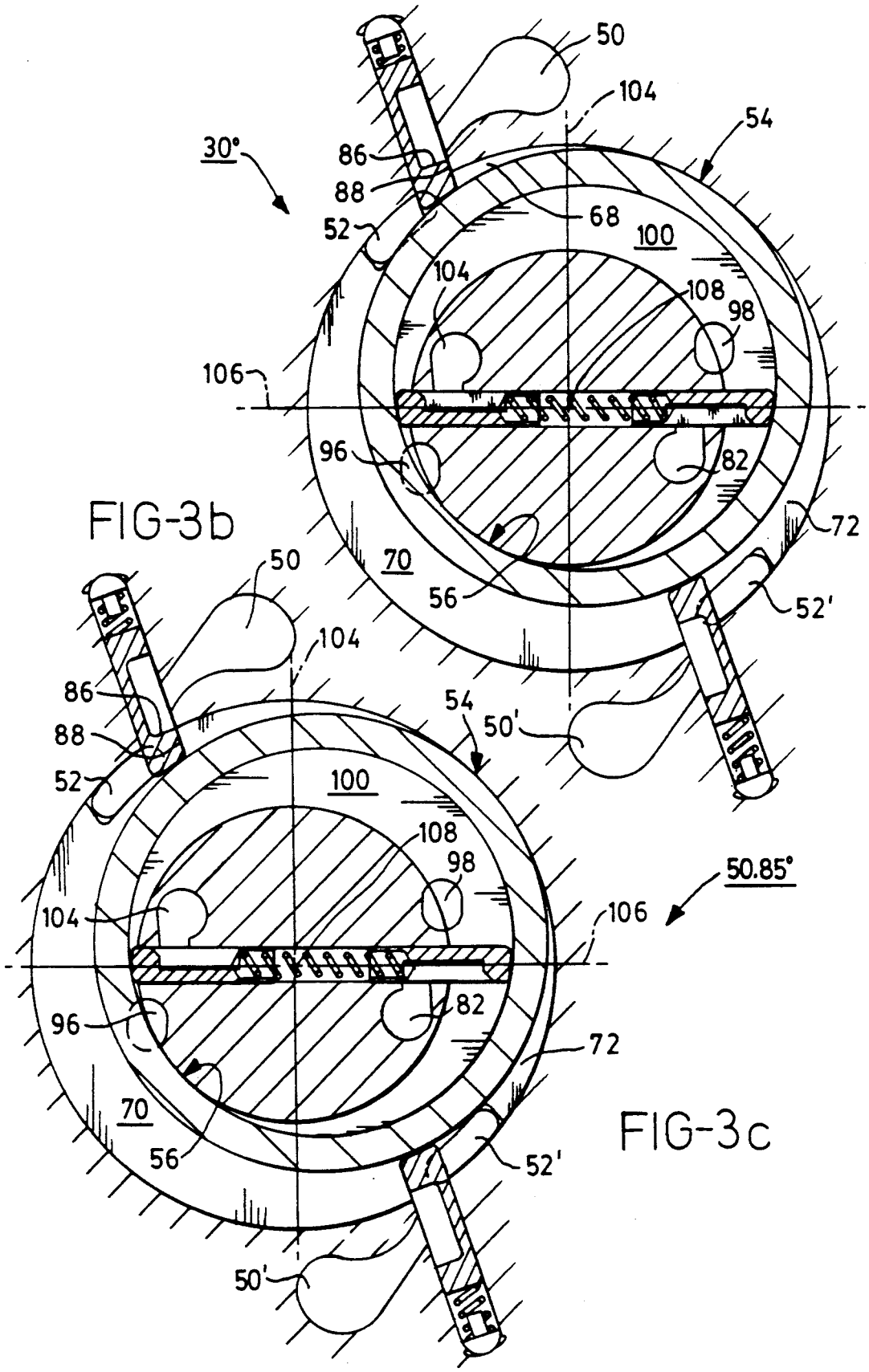

As seen in FIG. 3*b*, chamber 68 increases in volume relative to the volume indicated at FIG. 3*a*. Further, the outer vane 60 is moved radially inward as the lands 86 and 88 of the outer vane 60 prepare to establish communication between suction port 50 and the chamber 68. Similarly, the space 72 decreases in volume as the vane 60' moves outwardly. The gasses that are compressed in the chamber 72 upon a decrease in the volume of the chamber 72 are pumped through the first stage outlet port 52' and through a one way flow valve into the second stage inlet port 82, suitable internal passage structure being formed in the housing 34 for this purpose.

Simultaneously with the displacement of the orbiting ring piston 30° in a clockwise direction, the chamber 94 defined by the inner surface of the orbiting ring piston and the orbiting surface of the post decreases in volume as the chamber 100 increases in volume. The gas that is compressed in chamber 94 is discharged through the second stage outlet port 96. The second stage inlet port admits refrigerant gas into the chamber 100 through a valve recess 106 formed in the vane 90. Vane 90 has a valve land 108 that registers with land 110 formed in the slot 44. Second stage outlet port 98 permits gas to be drawn from the second stage inlet port because the second stage outlet port 98 has a one-way flow valve that prevents reverse flow of refrigerant gas into the expanding chamber 100.

As the orbital ring piston moves from the 30° position of FIG. 3*b* to the 50.85° position shown in FIG. 3*c*, the chamber 100 decreases in volume and the pressure thus created in the chamber 100 opens the one-way flow valve for the second stage outlet port 98. This occurs as second stage outlet port 96 continues to discharge gasses through its one-way flow valve as the chamber at 94 decreases in volume.

The outer vane 60 allows communication between the suction port 50 and the expanding chamber 68. Further, the other outer vane 60' continues to establish communication between suction port 50' and the expanding chamber 70. This occurs as the vane 60' continues to move radially outward.

Figure 3D:
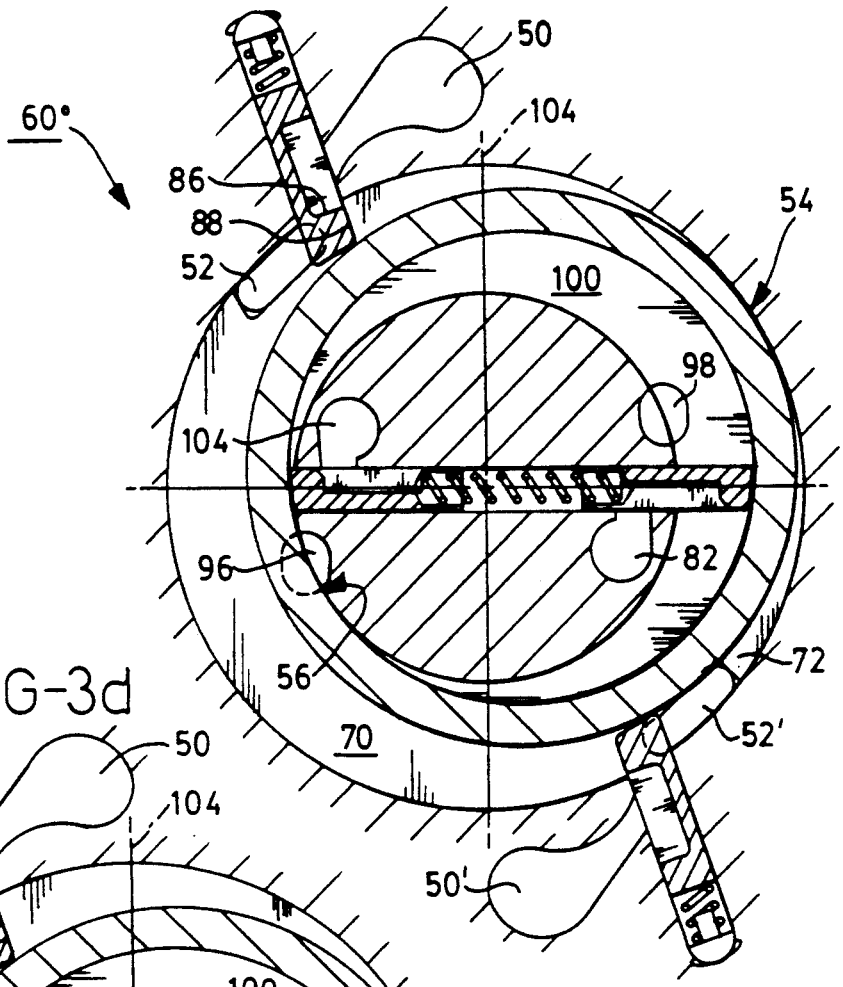
Figure 3E:
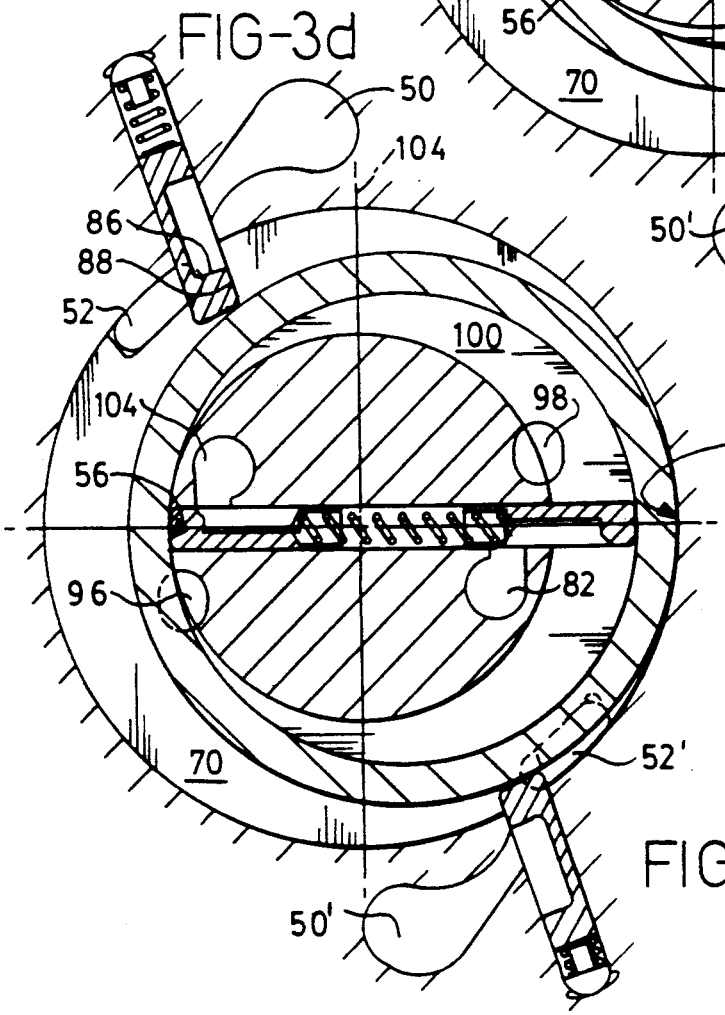
Figure 3F:
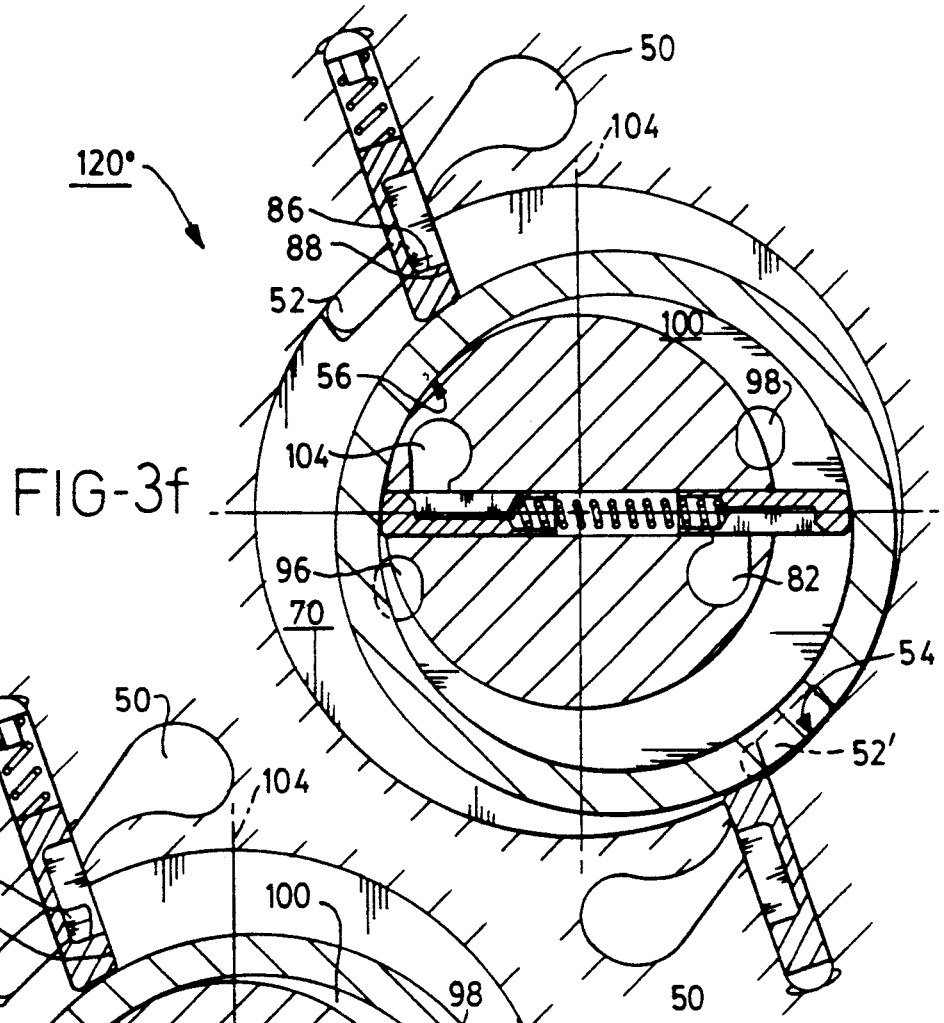
Figure 3G:
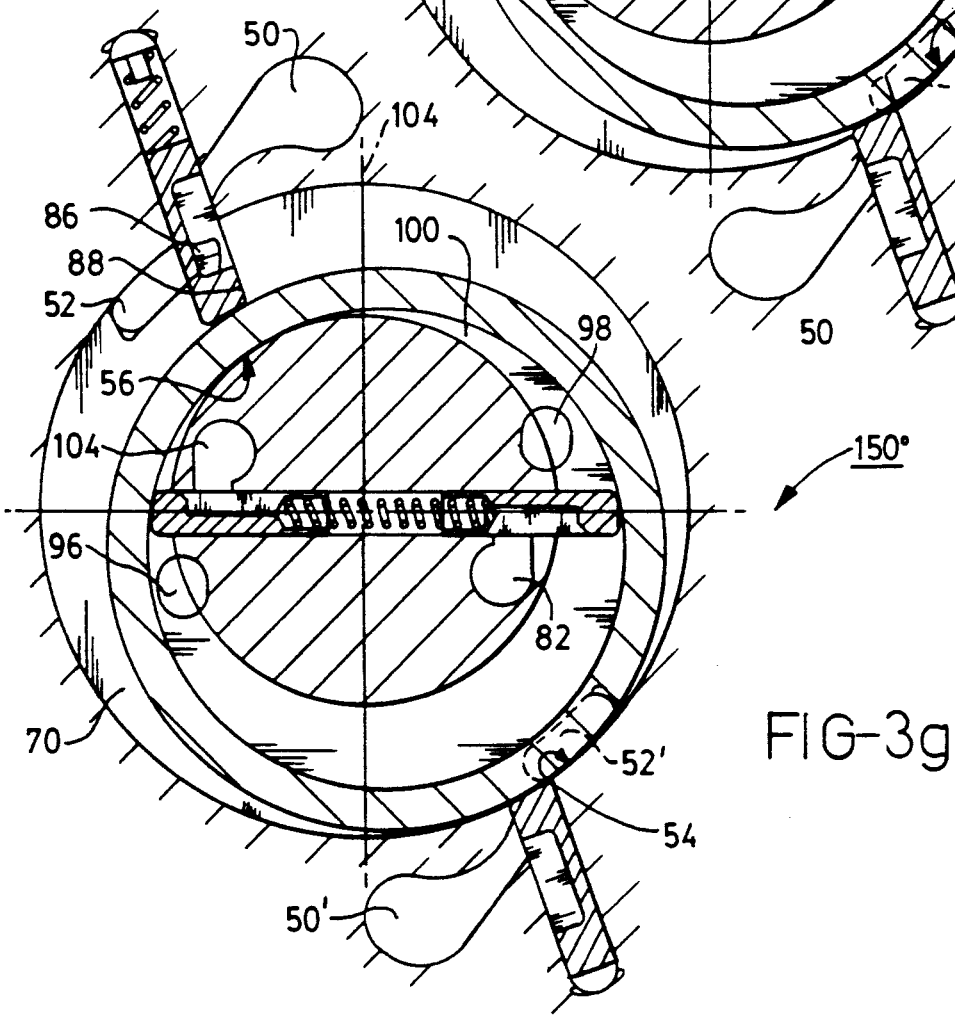
Figure 3H:
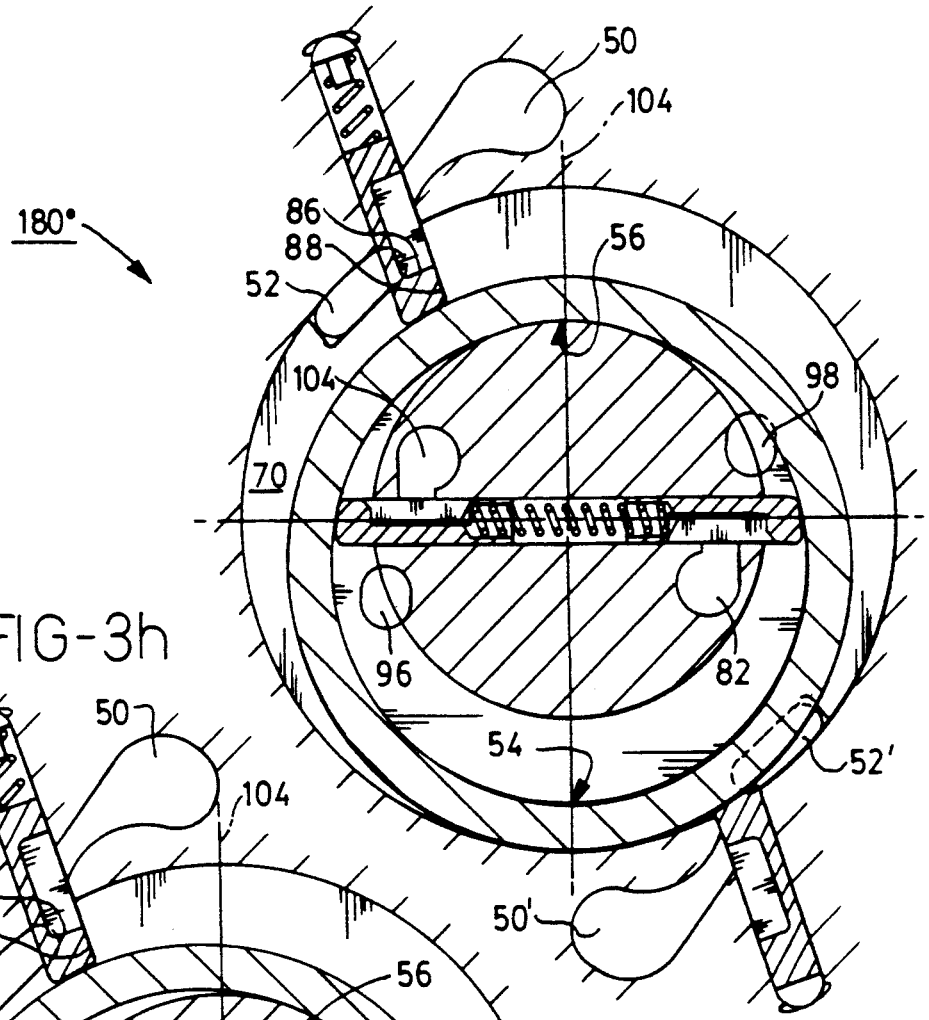

When the orbital ring piston is rotated to the 60° position shown in FIG. 3*d*, the chamber 68 is expanded further in volume as the valve opening 66 continues to admit intake gas through the suction port 50 and across the valve lands 86 and 88. Chamber 72 continues to decrease in volume as gas is discharged through the port 52'. Contact point 56 between the outer surface of the post and the inner surface 26 of the orbital ring piston now is located directly adjacent the second stage outlet port 96. The gas in chamber 94 at that time is substantially all discharged into the second stage outlet port. The chamber 74 is in full communication with the second stage inlet port 82 through the fully opened valve opening 80 in the vane 78. Chamber 74 continues to expand as the orbital ring piston is rotated to the 90° position in FIG. 3*e*, to the 120° position shown in FIG. 3*f*, to the 150° position shown in FIG. 3*g*, and finally to the 180° position as shown in FIG. 3*h*. The one-way flow valve in the port 96 prevents reverse flow of refrigerant gas at this time.

Figure 3I:
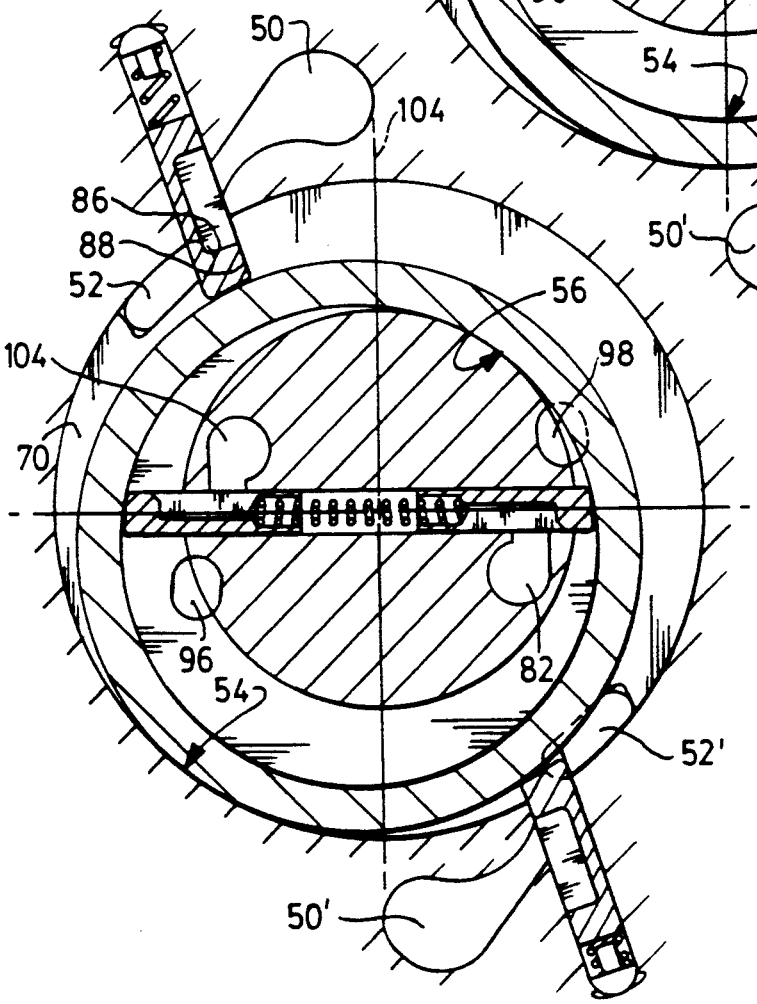
Figures 3J, 3K:
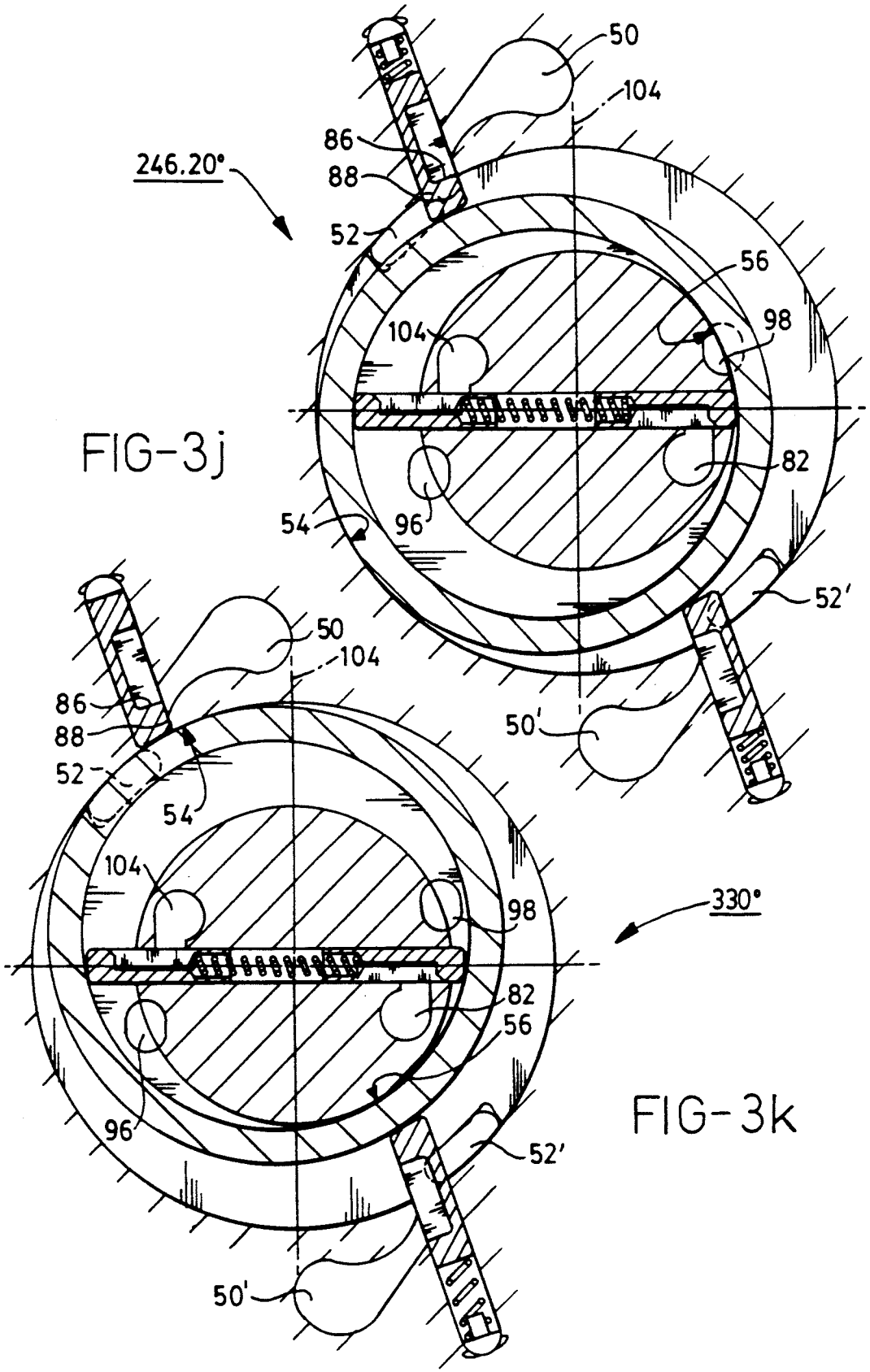

When the orbital ring piston moves to the 210° position shown in FIG. 3*i*, the valve lands 84 and 82 seal the second stage inlet port from the chamber 74, the gas in the chamber 74 begins to be compressed and the valve in the second stage outlet port 96 opens. Simultaneously with this action, the volume of chamber 100 progressively decreases as fluid is pumped from the second stage outlet port 98. When the orbital ring piston reaches the 246.20° position shown in FIG. 3*j*, substantially all of the fluid in the chamber 100 is exhausted through the outlet port 98.

In the 210° position shown in FIG. 3*i*, the valve lands 84 and 83 seal the chamber 74 from the inlet port 82, thereby permitting compression to take place. As the chamber 74 decreases in volume, the gases are discharged through the port 96. Simultaneously, chamber 72 begins to decrease in volume as gases in chamber 72 are discharged through the port 52'.

It is apparent from the foregoing that the pump action occurs in two stages. Each stage has two pumping chambers. The compression chambers for the first stage discharge into the inlet ports for the second stage compression chambers. The gases compressed in the first stage are compressed further in the second stage.

We have shown in FIGS. 3*a* through 3*k* a controller for the outer vanes. This comprises a valve spool 112 located in a valve opening 114 formed in the housing 34. Valve spool 112 includes three spaced lands 116, 118 and 120. A suction passage 122 communicates at one end with the suction port 50. When the valve spool 112 is positioned as shown in FIG. 3*a*, passage 122 communicates with the suction port 50 through the space between lands 116 and 118. Similarly, passage 122 communicates with the pumping chamber 68 through the space between lands 118 and 120. Passage 122 communicates with second stage inlet port 104 through passage 124 formed in the housing 34.

Valve spool 112 can be shifted within the valve opening 114 by solenoid actuator 126. Actuator 126 comprises solenoid windings 128 surrounding armature 130. Valve spool 112 normally is urged in a left-hand direction by valve spring 132. When the solenoid is energized, valve spool 112 is shifted in a right-hand direction, thereby interrupting communication between second stage inlet port 104 and the suction port 50. When the valve spool 112 is moved in a left-hand direction, a detent portion 134 on the valve spool engages vane 60 and locks it in its outermost position, as shown in FIG. 3A. This effectively disables the vane. Thus only a single compression chamber for the first stage is established, which reduces the capacity of the compressor. The second stage inlet port communicates directly with the suction port 50, as explained previously. Second stage inlet port is not fed in this instance from the first stage outlet port.

We have found that by disabling one of the outer vanes, the capacity of the compressor is reduced to about 70% of its maximum capacity. This is sufficient for high speed operation. Reducing the effective displacement in this way conserves compressor energy. The solenoid, in effect, allows the compressor to open an alternate suction pressure source for the port 104.

A solenoid actuator for the other outer vane 60' also can be used to activate and deactivate the other outer vane selectively. This actuator is illustrated also in FIG. 3*a*. Its operation is the same as that described with reference to the actuator for vane 60.

When the solenoid actuator for the vane 60' locks the vane 60' in its outer position, a suction gas flow passage similar to the passage 124 is established between suction port 50' and the second stage inlet port 82. When the solenoid actuator for the vane 60' is energized, the vane 60' will operate in the usual fashion. Thus, either one or both of the outer vanes can be locked, depending upon the capacity that is required. If minimal capacity is called for, both vanes can be deactivated by the respective solenoid actuators. In this instance, the inner compression chambers established by the inner surface of the orbital ring piston and the outer surface of the post function as second stage compressor chambers of reduced capacity. If both outer vanes are deactivated, pumping capacity of the compressor is reduced to about 50% of its maximum capacity. Thus, it is possible to tailor the pump capacity to the actual operating requirements of the compressor, thereby making it possible to conserve energy.

Figure 4A:
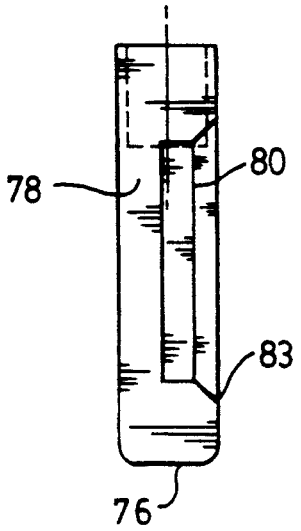
FIG. 4*a* shows an end view of an inner vane that registers with the cylindrical post of the compressor.
Figure 4B:
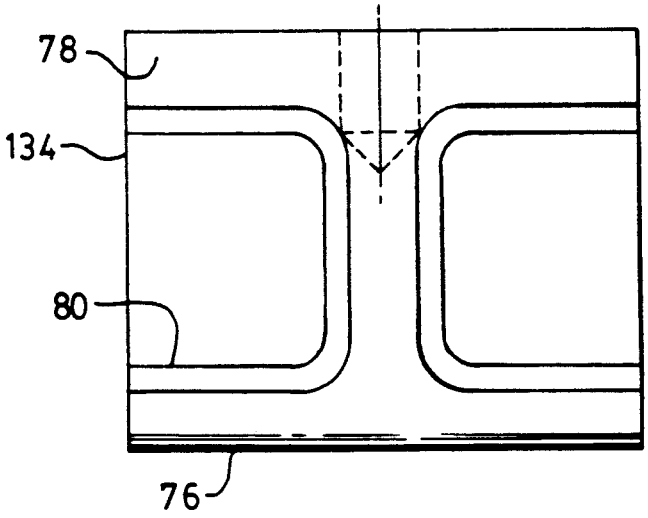
FIG. 4*b* is a view of the vane of FIG. 4*a* as seen from the plane of Section line 4B of FIG. 4*a;*

As seen in FIGS. 4*a* and 4*b*, the inner vane 78, which may be identical to the inner vane 90, is provided with a side opening 134 which communicates with the internal passage in the housing 34 that connects the first stage outlet port 52' with the second stage inlet port 82. Communication between port 52' and port 82 is controlled, as mentioned earlier, by valve land 83 formed on the inner vane 78.

Figure 5A:
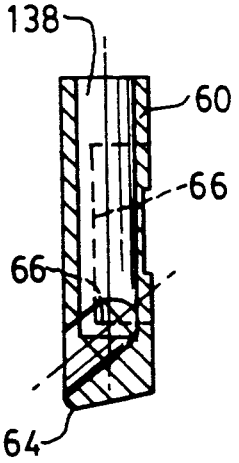
FIG. 5*a* is an end view of an outer vane that slidably registers with the stationary outer housing of the compressor.
Figure 5B:
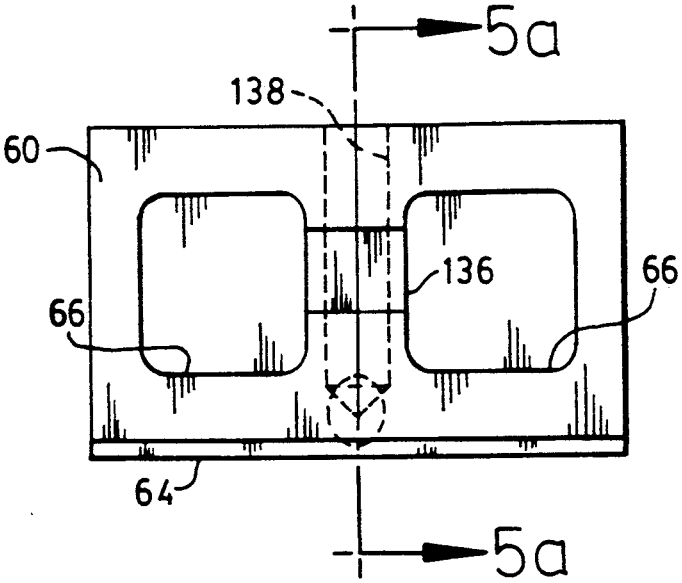
FIG. 5*b* is a view from the plane of Section line 5*b* of FIG. 5*a.*

As seen in FIGS. 5*a* and 5*b*, the vane 60, which may be identical to vane 60, includes a central portion 136 in which is machined a spring pocket 138 for receiving the spring 62. The valve opening 66 actually is in two parts, as indicated in FIG. 5*b*.

Having described a preferred embodiment of our invention, what we claim and desire to secure by U.S. Letters Patent is:

1. A two-stage rotary gas compressor comprising:
   - a housing, a compressor cavity in said housing having an internal cylindrical surface with a first axis;
   - a post substantially coaxial with said first axis and having a cylindrical surface spaced radially from said internal surface, a transverse slot in said post;
   - an orbital ring piston mounted for rotary movement about a second axis displaced radially from said first axis, said ring piston being located in said cavity between said internal surface and said post, said piston having an outer cylindrical surface in contact with said internal surface and an inner cylindrical surface in contact with said port;
   - a vane slot in said housing, an outer vane mounted for movement in said slot into contact with said outer cylindrical surface of said piston;

an inner vane mounted in said transverse slot for movement into contact with said inner cylindrical surface;

a first stage inlet passage adapted to be opened and closed by movement of said outer vane in said housing slot;

a second stage inlet passage adapted to be opened and closed by movement of said inner vane in said transverse slot;

a first stage discharge port in said housing communicating with said second stage inlet passage;

means for disabling said outer vane to prevent its movement into contact with said outer cylindrical surface whereby the capacity of said compressor can be reduced with an accompanying reduction in torque required to drive said piston;

said housing vane slot and said outer vane having cooperating valve lands whereby flow of gas to said compressor cavity is interrupted when said outer vane is moved radially outward from said second axis;

said inner vane and said transverse slot having cooperating valve lands whereby flow of gas through said second stages inlet port is interrupted when said inner vane is moved radially inward in said transverse slot.

2. An orbital ring piston gas compressor comprising:

a compressor housing, a compression chamber formed in said housing, said chamber having an inner surface with a first geometric axis;

a post substantially coaxial with respect to said compression chamber and having an outer surface;

an orbital ring piston mounted for orbital movement about a second geometric axis that is offset relative to said first geometric axis, said orbital ring piston having an outer surface adapted to contact said compression chamber inner surface and an inner surface adapted to contact said outer surface of said post;

outer vanes carried by said housing and adapted to move into engagement with said orbital ring piston outer surface;

inner vanes mounted on said post adapted to engage said orbital ring piston inner surface;

said outer vanes cooperating with said orbital ring piston and said compression chamber to define first and second compression chamber portions, said inner vanes cooperating with said orbital ring piston and said post to define third and fourth compression chamber portions, first and second first-stage inlet ports in said housing communicating with said first and second compression chamber portions, first and second second-stage outlet ports communicating with said third and fourth compression chamber portions;

said second-stage inlet ports communicating with said first-stage outlet ports; and means for selectively disabling each of said outer vanes whereby said outer vanes are held against movement into engagement with said orbital ring piston;

said means for disabling said outer vanes comprising a valve assembly having valve openings extending to said outer vanes and movable valve elements in said valve openings;

first and second solenoid actuator means for respectively shifting first and second ones of said valve elements toward and away from said outer vanes;

gas suction passage structure communicating with said second stage inlet ports; and valve lands on said valve elements adapted to block said gas suction passage structure when said valve elements are moved by said first and second actuator means away from said outer vanes.

3. The combination as set forth in claim 2 wherein said outer vanes include flow valve lands, said first and second first-stage inlet ports being defined in part by said outer vane flow valve lands whereby flow of gas to said first and second compression chamber portions is interrupted when said outer vanes are held against movement toward said piston;

each of said means for selectively disabling said outer vanes comprising a valve assembly having a valve opening extending to one of said outer vanes and a movable valve element in one of said valve openings;

a solenoid actuator means for shifting each of said valve elements toward and away from said outer vanes;

gas suction passage structure communicating with said second stage inlet ports; and a valve land on each of said valve elements adapted to block said gas suction passage structure when said valve element is moved by said actuator means away from said outer vanes.

4. The combination as set forth in claim 3 wherein said inner vanes include flow valve lands, said first and second second-stage inlet ports being defined in part by said inner vane flow valve lands whereby flow of gas to said third and fourth compression chamber portions is interrupted when said inner vanes are moved radially inward in said port;

each of said means for selectively disabling said outer vanes comprising a valve assembly having a valve opening extending to one of said outer vanes and a movable valve element in each of said valve openings;

a solenoid actuator means for moving each of said valve elements toward and away from said outer vanes;

a gas suction passage means for supplying gas to said second stage inlet port; and a valve land on each of said valve elements adapted to block said gas suction passage structure when said valve element is moved by said actuator means away from said outer vanes.

5. A two-stage rotary gas compressor comprising:

a housing, a compressor cavity in said housing having an internal cylindrical surface with a first axis;

a post substantially coaxial with said first axis and having a cylindrical surface spaced radially from said internal surface, a transverse slot in said post;

an orbital ring piston mounted for rotary movement about a second axis displaced radially from said first axis, said ring piston being located in said cavity between said internal surface and said post, said piston having an outer cylindrical surface in contact with said internal surface and an inner cylindrical surface in contact with said post;

a vane slot in said housing, an outer vane mounted for movement in said slot into contact with said outer cylindrical surface of said piston;

an inner vane mounted in said transverse slot for movement into contact with said inner cylindrical surface;

a first stage inlet passage adapted to be opened and closed by movement of said outer vane in said housing slot;

a second stage inlet passage adapted to be opened and closed by movement of said inner vane in said transverse slot;

a first stage discharge port in said housing communicating with said second stage inlet passage; and means for disabling said outer vane to prevent its movement into contact with said outer cylindrical surface whereby the capacity of said compressor can be reduced with an accompanying reduction in torque required to drive said piston;

said means for disabling said outer vane comprising a valve assembly having valve openings extending to said outer vanes and a movable valve element in said valve openings;

a solenoid actuator means for moving said valve element toward and away from said outer vanes;

a gas suction passage means for supplying gas to said second stage inlet port; and valve lands on said valve element adapted to block said gas suction passage structure when said valve element is moved by said actuator means away from said outer vane.

* * * * *